United States Patent [19]

Reiner

[11] Patent Number: 4,489,513

[45] Date of Patent: Dec. 25, 1984

[54] MULTIPLEX SIGN INDICIA

[76] Inventor: Jack L. Reiner, 508 Luella Ave., Calumet City, Ill. 60409

[21] Appl. No.: 432,265

[22] Filed: Nov. 24, 1982

[51] Int. Cl.[3] ..... G09F 9/30

[52] U.S. Cl. ..... 40/447; 434/96; 434/160

[58] Field of Search ..... 434/160, 81, 96; 40/584, 447, 596, 600, 621, 124.1

[56] References Cited

U.S. PATENT DOCUMENTS

| | | | |
|---|---|---|---|
| 322,754 | 7/1885 | Schueller | 434/160 |
| 1,989,855 | 2/1935 | Frank | 40/596 |
| 2,257,200 | 9/1941 | Smith | 434/365 |
| 3,839,130 | 10/1974 | Dean et al. | 40/621 X |

FOREIGN PATENT DOCUMENTS

| | | | |
|---|---|---|---|
| 1231193 | 4/1960 | France | 434/160 |

*Primary Examiner*—William H. Grieb

[57] ABSTRACT

The invention relates to spectacular, promotional signs suitable for windows, walls and stretched supports, and comprises flexibly connecting a multiplicity of component parts to form giant, self-contained letters, numbers and other characters that are easily folded to compact size without creasing the parts, and are easily separated to accommodate window dividers during installation. In preferred form, the parts are arranged by color to form giant characters that appear to be three dimensional, said parts being made from paper and connected by tape to provide temporary signs that are economical.

10 Claims, 2 Drawing Figures

MULTIPLEX SIGN INDICIA

BACKGROUND OF THE INVENTION

This invention relates to signs in general and more particularly concerns larger indicia such as gaint letters, numerals and other characters provided by prior art methods such as sign painting, printing and die-cutting to a limited degree.

An important object of this invention is to provide a new and improved method of fabricating gaint, self-contained characters that range in height from 3feet or less, to 18 feet or more, said characters being suitable for inexpensive and spectacular promotional signs that can be easily installed by anyone with ordinary skill, and easily affixed to existing surfaces such as store windows, walls and stretched supports.

A further object of this invention is to provide said characters that are easy to fabricate.

A further object of this invention is to provide said characters that are economical.

A further object of this invention is to provide said characters that are immediately available.

A further object of this invention is to provide said characters that are easily formed to appear to be three dimensional.

A further object of this invention is to provide said characters that are suitable for separating.

A further object of this invention is to provide said characters that are suitable for folding.

A further object of this invention is to provide said characters that are easy to install and remove.

SUMMARY OF THE INVENTION

In accordance with the invention, gaint sign indicia such as letters, numerals and other characters are fabricated in a novel way by flexibly connecting a multiplicity of pre-formed shapes that were determined by multiplex separation of indicia into component parts, each part being identical in shape to one or more parts of one or more configurations that differ in character. In preferred form, said shapes are made from paper and connected by tape to provide inexpensive characters suitable for temporary signs.

The central problem with enormous, self-contained characters is that of handling them. In preferred form, the above mentioned parts are made from thin material and sufficiently spaced to provide novel capability for folding gaint configurations to managable size. Said spacing simplifies folding and allows compact folding to the size of a single part. For example, a 7 foot letter folds to 14 inches square, and an enormous 18 foot letter folds to a manageable 36 inches square, intact. Said spacing further allows folding without defacing said parts with unsightly creases, and provides capability for folding configurations of thin, rigid material that otherwise could not be folded without creasing or cracking the material. Fabricating gigantic characters is simplified by folding in conjunction with connecting, and installing said characters is simplified by unfolding in conjunction with affixing. Said folding quality greatly reduces the cost of forming, handling, packaging, storing, delivering, installing and removing huge characters.

Said spacing provides novel capability for variously separating configurations by severing certain connecting means only, when it is necessary to accommodate and conform to window dividers or otherwise simplify installation.

Further novelty can be found in a preferred method of fabricating characters of huge sizes, which comprises arranging entire stacks of thin, pre-formed shapes side by side into fixed assembly, and flexibly connecting the top shape of each stack securely to its adjacent members, whereby a self-contained configuration is easily lifted away while leaving the arrangement intact, and whereby only one arrangement of shapes per character is required to mass produce each character.

The preferred shapes in the drawing are easily and expeditiously formed by employing straightedge cutting equipment to sever stacks of square sheet material, whereby only one or two cuts are required to mass produce a stack of each shape, ready for stacked assembly, each stack being over 1,000 shapes when using paper.

Additional novelty can be found in preferred form wherein simple arrangement by light and dark color creates an optical illusion, whereby completed characters appear to be three dimensional when viewed from a distance, said special effect being accomplished in one, easy procedure and having advantage over prior art methods of printing which require one procedure per color. Likewise, giant multicolor characters are formed in one procedure.

With the above and such other objects in view as may hereafter more fully appear, this invention consists of the novel combinations and arrangements of parts, to be connected by conventional means, as will be evident from the accompanying drawings and specification, but it is to be understood that changes and modifications may be resorted to which come within the scope of the invention as claimed without departing from the spirit and nature of the invention.

A preferred form of embodiment of the invention is an embodiment as shown in the accompanying drawings in which:

Figures 1, 2:
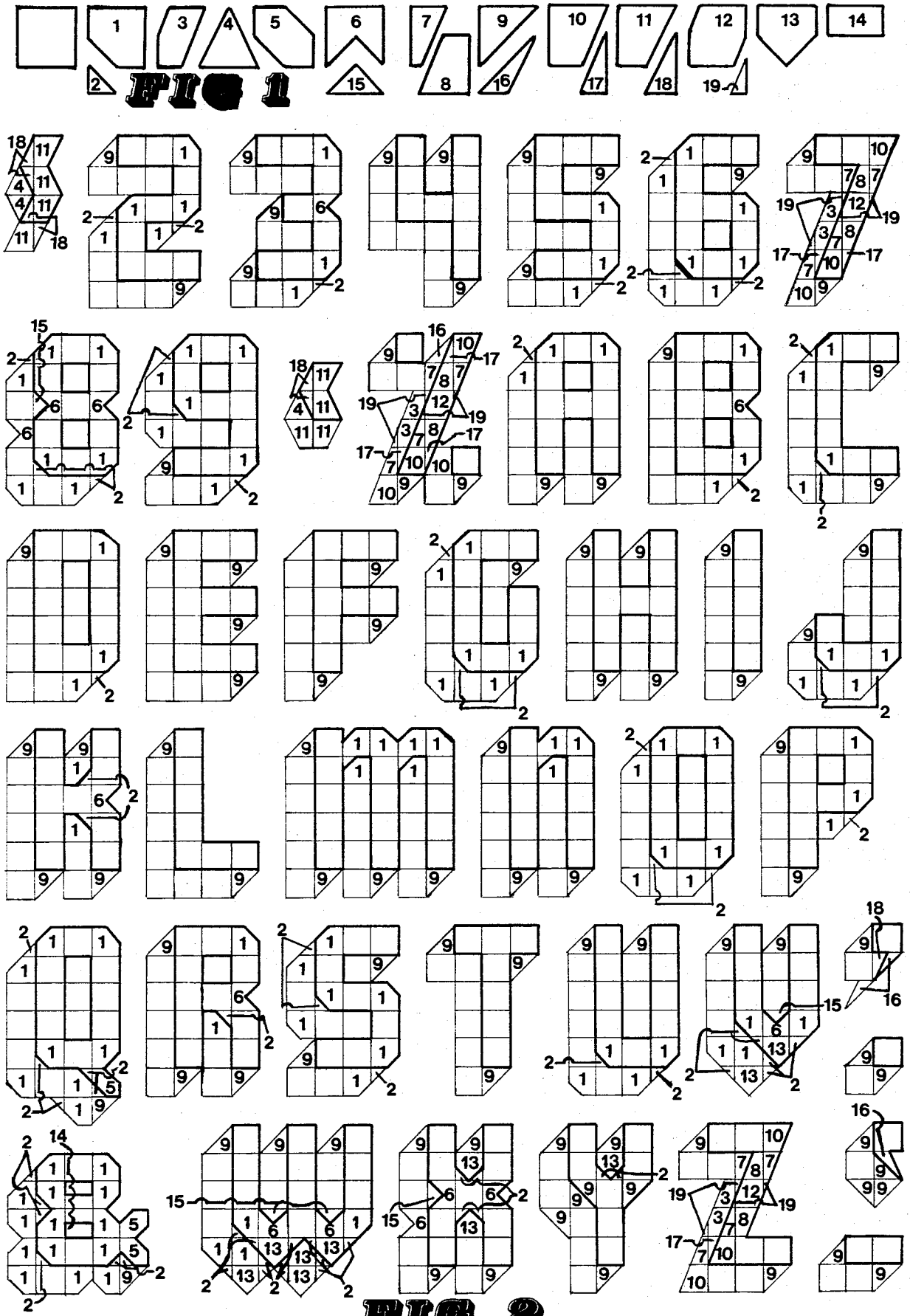
FIG. 1 is a front side view of the basic square and a selection of nineteen other shapes, each of which are easily formed by separating said basic square into two or more parts by means of simple straight-line cutting only. Shapes which, when properly assembled, form a particular style of characters.
FIG. 2 is a front-side view of the basic square and nineteen other shapes in assembled forms which represent letters, numbers and other characters of a particular style.

Since most of the characters shown in FIG. 2 are made up principally of squares, the basic square as shown in FIGS. 1 and 2 is not identified by number so as to simplify identification of, and easy reference to, the other parts. Reference numbers shown in FIG. 2 were placed within each part where practicable so as to further simplify identification. The shapes shown in FIG. 1 are displayed in a manner which permits easy recognition of their relationship to the basic square, and that, in the forming of said shapes by separating the basic square, two or more usable shapes result, which entirely eliminates the waste factor.

DETAILED DESCRIPTION OF PREFERRED EMBODIMENTS

Shapes 1 and 2 are formed by cutting at a 45 degree angle from the center point of a side-edge. Shapes 3, 7 and 19 are formed by cutting at a 22 degree angle from the center point of a side-edge, and then, by making a second and parallel cut from a point equal to the point at which part was removed from the contiguous side-edge, and resting at the opposite end of said side-edge. Shapes 4 and 18 are formed by cutting from the center point of a side-edge to each end point of the opposite side-edge. Shapes 5 and 2 are formed by parallel cutting at a 45 degree angle from the center points of opposite side-edges. Shapes 6 and 15 are formed by cutting from each end point of a side-edge to the center point of the square. Shapes 7 and 8 are formed by the same method as shown for shapes 3, 7 and 19 above except that the 22 degree angle is scored instead of cut so as to determine the angle for cutting. Shapes 9, 16 and 17 are formed by cutting at 45 and 22 degree angles respectively, both from the same end point of a side-edge. Shapes 10 and 17 are formed by cutting at a 22 degree angle from an end point of a side-edge. Shapes 11 and 18 are formed by cutting at a 22½ degree angle from an end point of a side-edge. Shapes 12 and 19 are formed by parallel cutting at a 22 degree angle from the center point of opposite side-edges. Shapes 13 and 2 are formed by cutting from the center points of opposite side-edges to the center point of a common contiguous side-edge. Shape 14 is formed by cutting from the center point of a side-edge to the center point of the opposite side-edge.

Light and heavy lines are used in FIG. 2 to distinguish between contrasting colors assembled in a manner which creates an three-dimensional illusion. In this preferred form of embodiment, the shapes are required to be of the same color front and back to permit reversal of shapes where needed.

I claim:

1. A method of fabricating giant, specialized sign indicia suitable for inexpensive and gigantic promotional signs which comprises:

arranging stacks of pre-formed shapes of thin material into fixed assembly and sufficiently spaced to provide capability for simplified folding; and flexibly connecting the top shapes and removing a self-contained configuration, in repeated sequence, whereby only one easy arrangement of shapes per character is required to mass produce each character.

2. A method in accordance with claim 1 wherein said shapes are easily arranged by light and dark color, whereby a giant character that appears to be three dimensional is fabricated in a single procedure.

3. A method in accordance with claim 1 wherein said shapes are easily arranged by color, whereby a gaint, multicolor character is fabricated in a single procedure.

4. A method in accordance with claim 1 wherein said shapes are the pre-formed shapes of FIG. 1.

5. A method in accordance with claim 4 wherein said shapes are pre-formed by severing stacks of square sheets, whereby only one or two straightedge cuts are required to produce an entire stack over 1,000 paper shapes.

6. For individual assembly into giant, sign indicia, the preformed shapes of FIG. 1.

7. Giant, specialized sign indicia wherein each character comprises a multiplicity of flexibly connected parts, said parts being of thin material and sufficiently spaced to provide capability for required, simplified folding, and folding in a manner that prevents creasing said parts.

8. Sign indicia in accordance with claim 7 wherein capability is provided for folding a giant character of thin, rigid material that otherwise could not be folded safely.

9. Sign indicia in accordance with claim 7 wherein capability is provided for easily separating a giant character so as to accommodate window dividers during installation, whereby only the connecting material at certain points is severed.

10. Sign indicia in accordance with claim 7 wherein said parts are made from paper and connected by tape to provide inexpensive, giant characters suitable for temporary signs.

* * * * *